US009890009B1

(12) United States Patent
Chen et al.

(10) Patent No.: US 9,890,009 B1
(45) Date of Patent: Feb. 13, 2018

(54) BAG DISPENSER

(71) Applicant: Inteplast Group Corporation, Livingston, NJ (US)

(72) Inventors: Daniel Chen, Morristown, NJ (US); Todd Hart, Kalamazoo, MI (US); Janine Paley, Ontario (CA); Tasneem Krishna, Piscataway, NJ (US); Kelvin Yang, Madison, NJ (US); Ben Tseng, Somerset, NJ (US)

(73) Assignee: Inteplast Group Corporation, Livingston, NJ (US)

( * ) Notice: Subject to any disclaimer, the term of this patent is extended or adjusted under 35 U.S.C. 154(b) by 0 days.

(21) Appl. No.: 15/281,547

(22) Filed: Sep. 30, 2016

(51) Int. Cl.
*B65H 35/10* (2006.01)
*B26F 3/02* (2006.01)

(52) U.S. Cl.
CPC ..... *B65H 35/10* (2013.01); *B26F 3/02* (2013.01); *B65H 2701/191* (2013.01)

(58) Field of Classification Search
CPC ..... B65H 35/10; B65H 2701/191; B26F 3/02
See application file for complete search history.

(56) References Cited

U.S. PATENT DOCUMENTS 320,576 A * 6/1885 Myers ..... B65H 35/0006 225/85
1,229,431 A * 6/1917 Farrell ..... A47K 10/22 242/596.3
4,621,755 A * 11/1986 Granger ..... A47K 10/3656 225/106
4,844,361 A * 7/1989 Granger ..... A47K 10/3687 225/93
5,054,675 A * 10/1991 Taves ..... A47K 10/38 225/19
5,135,146 A 8/1992 Simhaee
5,219,424 A * 6/1993 Simhaee ..... B65D 33/002 225/106
5,261,585 A 11/1993 Simhaee
5,433,363 A * 7/1995 Simhaee ..... B65D 33/002 206/390
5,558,262 A 9/1996 Simhaee
6,170,726 B1 * 1/2001 Jensen ..... A47F 13/045 225/12
6,199,788 B1 3/2001 Simhaee
6,279,806 B1 * 8/2001 Simhaee ..... A47F 9/042 225/106
6,685,075 B1 * 2/2004 Kannankeril ..... A47F 9/042 225/106
7,270,256 B2 9/2007 Daniels
7,424,963 B2 9/2008 Daniels
(Continued)

*Primary Examiner* — Sean Michalski
(74) *Attorney, Agent, or Firm* — Senniger Powers LLP

(57) ABSTRACT

A dispenser for dispensing bags from a roll includes a base, a bag separator, and a swing arm pivotably mounted on the base that includes a roll retaining portion shaped and arranged for being received in an axial opening of the roll. The swing arm is pivotable with respect to the base about a pivot axis in a braking direction in which the roll retaining portion travels toward the base. A spring is operatively connected between the swing arm and the base to bias the swing arm in the braking direction whereby, when the roll retaining portion is received in the axial opening, the roll retaining portion engages the roll and urges the roll into braking engagement with the base.

19 Claims, 9 Drawing Sheets

(56) References Cited

U.S. PATENT DOCUMENTS

| | | | | |
|---|---|---|---|---|
| 7,591,405 | B2 | 9/2009 | Daniels | |
| 8,251,270 | B2 | 8/2012 | Tseng | |
| 8,844,783 | B2 | 9/2014 | Tan | |
| 8,875,968 | B2 | 11/2014 | Tan | |
| 8,905,283 | B2 | 12/2014 | Tan | |
| 9,199,820 | B2 * | 12/2015 | Tseng | B65H 35/10 |
| 2003/0019972 | A1 * | 1/2003 | Goldberg | A47K 10/38 242/570 |
| 2003/0098326 | A1 * | 5/2003 | Wile | A47F 9/042 225/77 |
| 2011/0073629 | A1 * | 3/2011 | Tseng | B26F 3/02 225/51 |
| 2012/0024884 | A1 * | 2/2012 | Wilfong | B65H 16/005 221/30 |
| 2012/0024885 | A1 | 2/2012 | Wilfong | |
| 2012/0305618 | A1 * | 12/2012 | Tan | B65H 35/10 225/47 |
| 2013/0134181 | A1 * | 5/2013 | Helseth | B65H 16/005 221/26 |
| 2017/0217709 | A1 * | 8/2017 | Wilfong | B65H 16/005 |

* cited by examiner

BAG DISPENSER

FIELD

The present disclosure relates generally to a bag dispenser and more specifically to a bag dispenser for dispensing bags from a roll for use in storing produce or the like.

BACKGROUND

Bag dispensers are used to dispense individual bags from a roll. For example, bag dispensers are commonly used to dispense individual bags from a roll of bags in a produce department of a grocery store. Conventional dispensers include a support that mounts the roll on a base while allowing the roll to rotate about an axis to unroll bags from the roll. In addition, typical dispensers include a bag separator that tears individual bags from the roll along preformed zones of weakness to separate the bags as they are unrolled from the roll. As bags are removed from the roll, it loses weight, making it more likely to freewheel in use. This may result in too many bags being pulled off the roll at one time. In addition, freewheeling can cause the roll of bags to become misaligned with the separator, and bags coming off the roll are more difficult to tear from the roll if they are not aligned with the bag separator. Still further, freewheeling can permit the roll to "jump" on the dispenser, causing the roll to over-rotate and permitting the leading bag to position itself under the roll or behind the roll with respect to the bag separator where it is difficult to grasp.

SUMMARY

In one aspect, a dispenser for dispensing bags from a roll comprises a base having a first end portion and a second end portion. A bag separator comprises a tongue projecting from the base adjacent the first end portion thereof and configured to separate bags from the roll as the bags are pulled across the tongue. A swing arm is pivotably mounted on the base and includes a roll retaining portion shaped and arranged for being received in an axial opening of the roll and engaging the roll therein. The swing arm is pivotable with respect to the base about a pivot axis in a braking direction in which the roll retaining portion travels toward the base. A spring is operatively connected between the swing arm and the base to bias the swing arm in the braking direction whereby, when the roll retaining portion is received in the axial opening, the roll retaining portion engages the roll and urges the roll into braking engagement with the base.

In another aspect, a dispenser for dispensing bags from a roll comprises a base having a first end portion and a second end portion. A bag separator comprises a tongue projecting from the base adjacent the first end portion thereof and is configured to separate bags from the roll as the bags are pulled across the tongue. A bearing collar is mounted on the base adjacent the second end portion thereof. A swing arm comprises a pin portion, an intermediate portion, and a roll retaining portion. The pin portion extends from the first end of the intermediate portion along a pivot axis. The roll retaining portion extends from the second end of the intermediate portion along an axis parallel to and spaced apart from the pivot axis. The intermediate portion extends between and connects the pin portion and the roll retaining portion. The pin portion includes a bearing segment that is rotatably received in the bearing collar to constrain the swing arm for pivoting movement about the pivot axis with respect to the base. The swing arm is pivotable with respect to the base about the pivot axis in a braking direction in which the roll retaining portion travels toward the base. A spring comprises a base end portion, an opposite swing arm end portion, and a coiled portion extending therebetween. The coiled portion of spring is located adjacent the bearing collar and receives the pin portion of the swing arm therein. The base end portion of the spring is engaged with the base and the swing arm end portion of the spring is operatively connected to the intermediate portion of the swing arm for conjoint movement therewith. The spring is oriented with respect to the swing arm and the base such that pivoting movement of the swing arm from a position in which the roll retaining portion is located adjacent the base in a direction opposite the braking direction deforms the spring whereby the spring imparts a biasing force upon the swing arm that urges the swing arm in the braking direction.

Other objects and features will be in part apparent and in part pointed out hereinafter.

BRIEF DESCRIPTION OF THE DRAWINGS

Corresponding reference characters indicate corresponding parts throughout the drawings.

DETAILED DESCRIPTION

Figure 1:
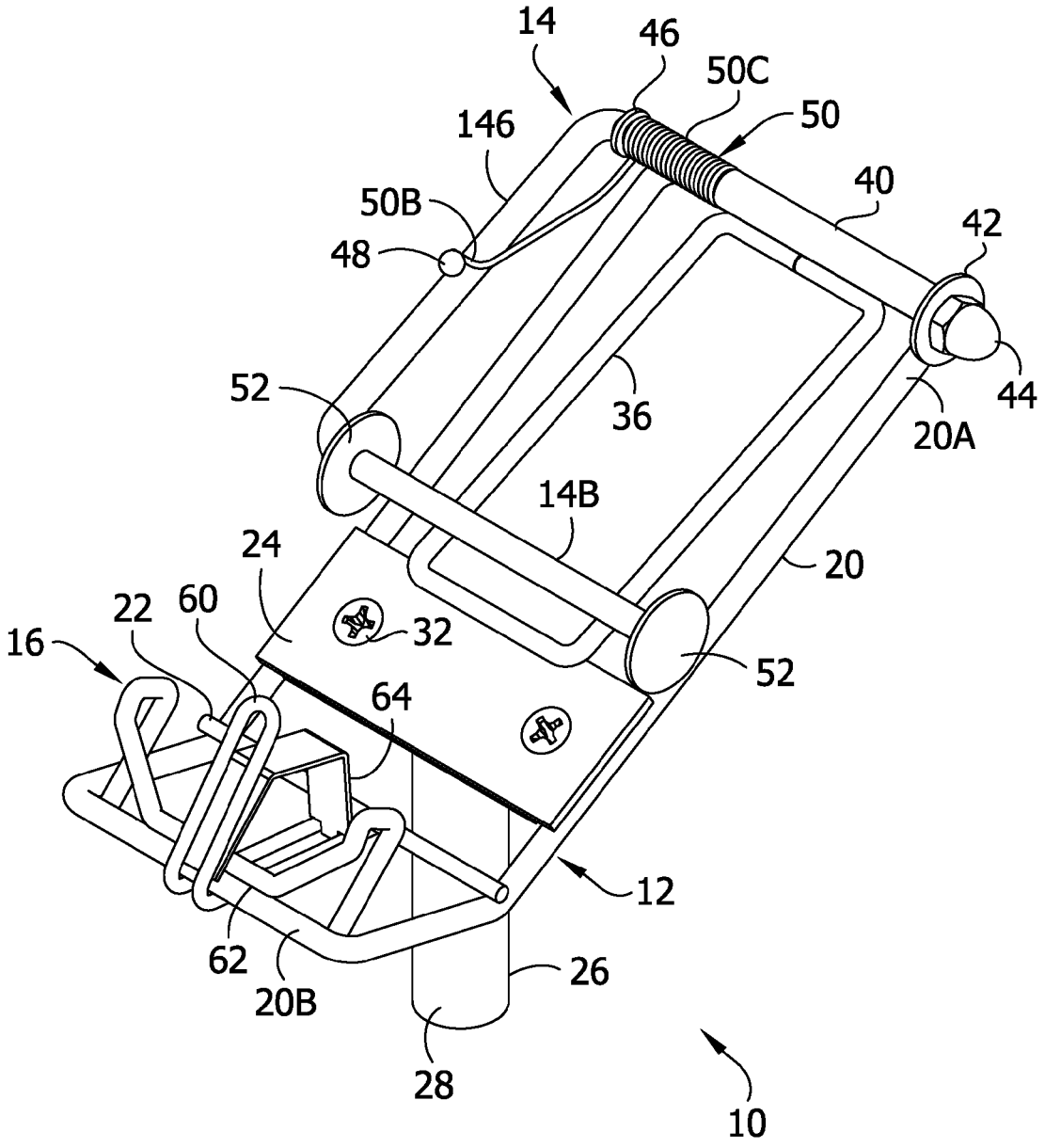
FIG. 1 is a perspective of a bag dispenser.

Referring to FIGS. 1-4, one embodiment of a dispenser for dispensing bags from a roll is generally indicated at reference number 10. The dispenser 10 includes a base, generally indicated at 12, that is configured to be mounted on a stand, wall, or other support article. A swing arm, generally indicated at 14, is pivotably mounted on the base and configured to support a roll R for rotation about the swing arm for unrolling individual bags B from the roll as explained below. As will be described more fully herein, the swing arm 14 is biased to urge braking engagement between the roll R and the base 10 to prevent freewheeling of the roll on the swing arm as the bags B are being dispensed. The bag dispenser 10 also includes a bag separator 16 that is supported on the base 12. As explained below, the separator 16 is configured to maintain operative alignment of the bags B as they are unrolled from the roll R and to separate the bags from the roll as they are pulled across the separator. Thus, it will be appreciated that the illustrated dispenser 10 is configured to ensure individual bags B are dispensed in a controlled manner without regard to the number of bags left in the roll R.

Figure 6:
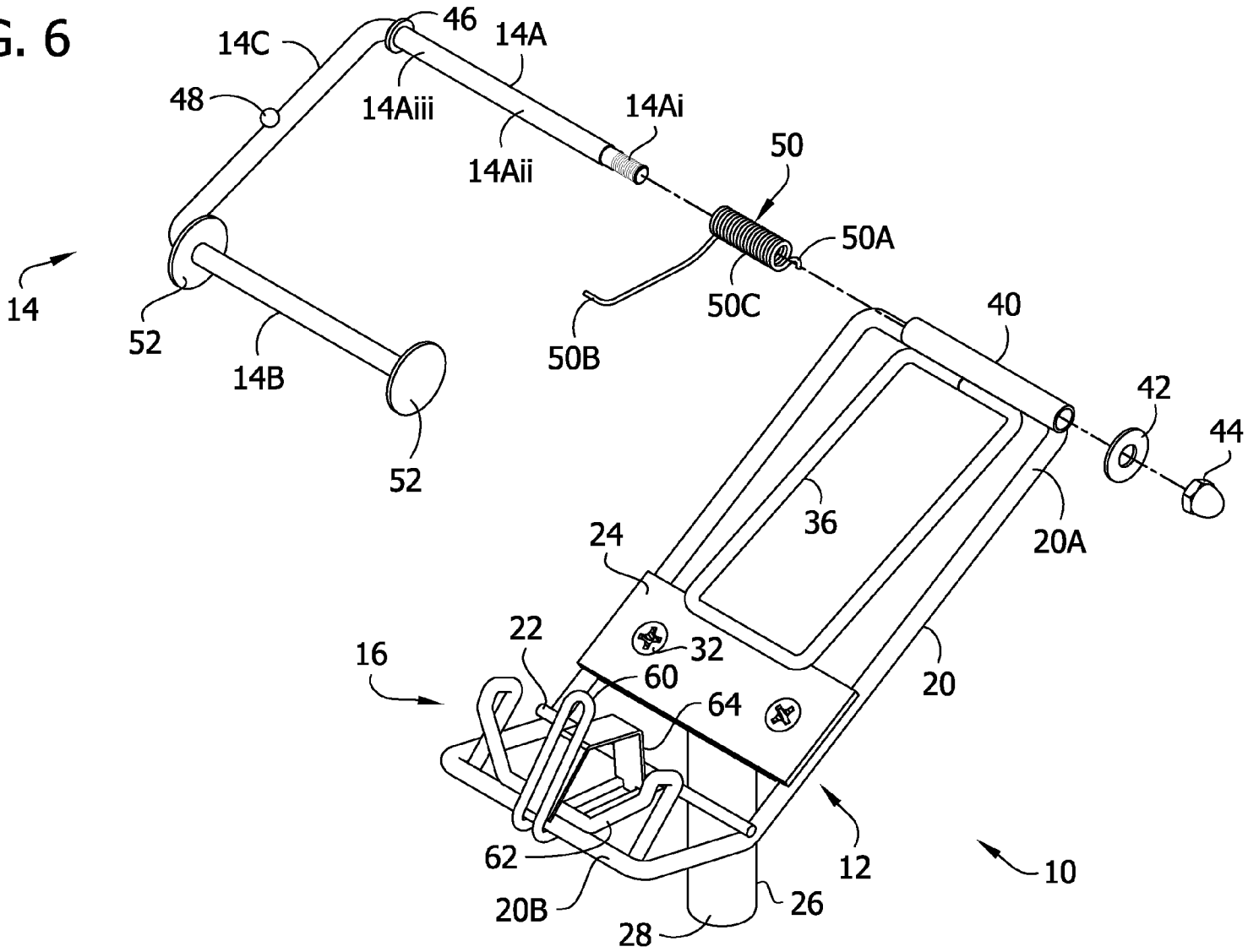
FIG. 6 is an exploded perspective of the dispenser illustrating how the swing arm is mounted on a base of the dispenser.
Figure 7:
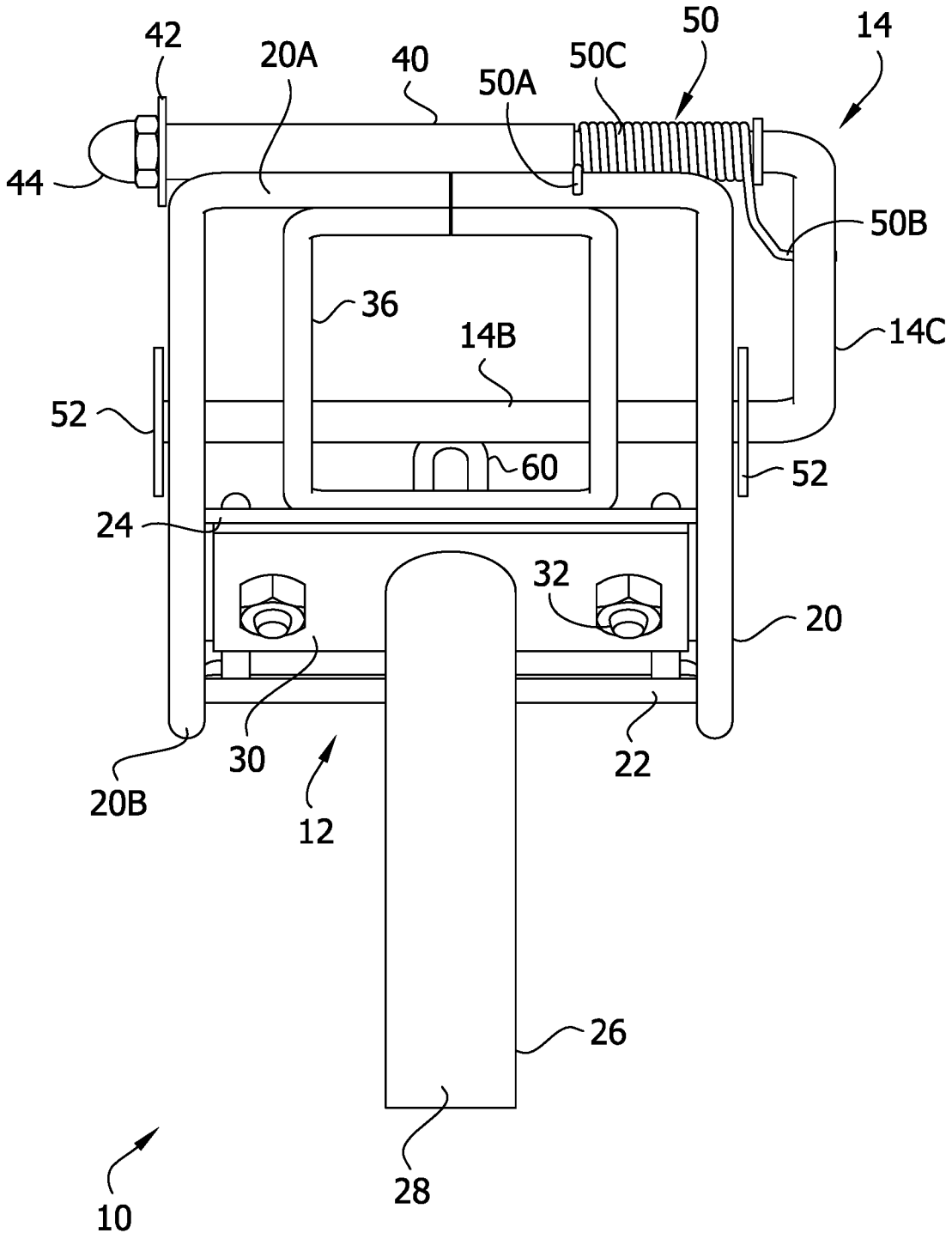
FIG. 7 is a rear elevation of the bag dispenser.

Referring to FIGS. 6 and 7, the base 12 includes a support frame 20. The illustrated support frame 20 has a rigid wire frame construction. That is, the support frame 20 is formed from a length of rigid wire that is bent to shape and whose ends are attached (e.g., welded) to one another. Support frames may have other constructions without departing from the scope of the invention. In the illustrated embodiment, the support frame 20 is formed into a bent, generally rectangular shape having a rear segment, a front segment, and opposite first and second side segments. The rear and front segments of the support frame 12 broadly form first and second end portions of the base 12. Here, the terms "rear" and "front" are used in reference to the direction in which bags B are unwound from the roll R in use. Bags B are pulled forward—that is, from adjacent the rear toward the front of the dispenser 10—from the roll R as they are dispensed.

The first and second side segments of the support frame 20 are bent to define a rear portion 20A and a front portion 20B of the support frame that extend generally in transverse planes. The front portion 20B of the support frame 20 includes the front segment and front portions of the first and second side segments of the rigid wire and defines a U-shape that extends generally in a first plane that slopes rearwardly at a shallow angle. The rear portion 20A of the support frame 20 likewise includes the rear segment and rear portions of the first and second side segments of the rigid wire and defines an inverted U-shape that extends generally in a second plane oriented transverse to the first plane and that slopes forwardly at a relatively steep angle. In the illustrated embodiment, the rear portion 20A extends upward at a transverse, non-perpendicular angle from the front portion 20B, such that the first and second planes have an obtuse included angle therebetween. A cross wire 22 is mounted on the support frame 20 (e.g., by welding to the side segments of the support frame, etc.) at the bend formed between the rear portion 20A and the front portion 20B. A mounting plate 24 is mounted on the first and second side segments of the support frame 20, on the rear portion 20A (e.g., by welding, etc.), at a location spaced apart rearward of the cross wire 22.

Figure 2:
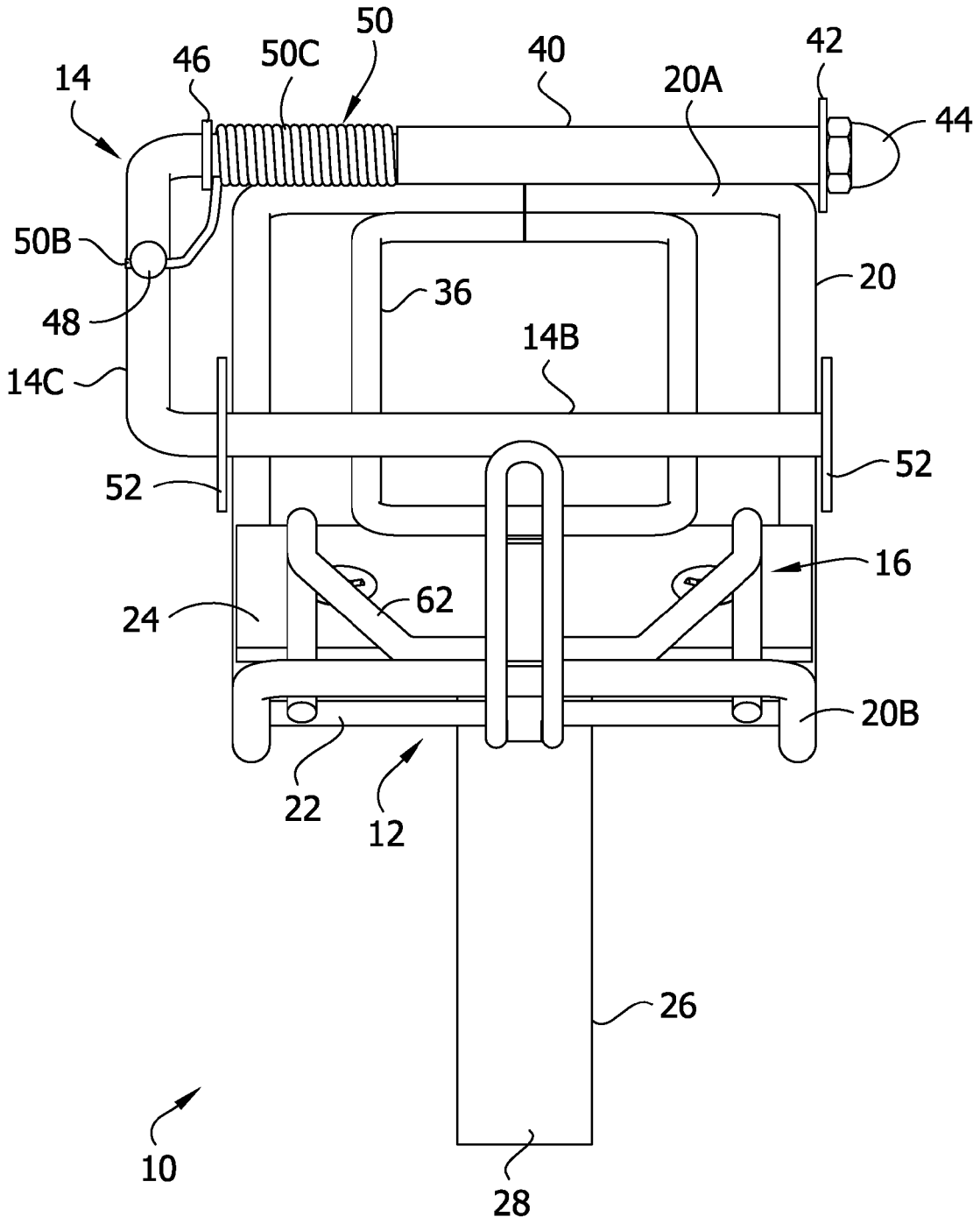
FIG. 2 is a front elevation of the bag dispenser.

Referring to FIGS. 1 and 2, the base 12 further includes a mounting assembly 26, which is configured to be attached to the mounting plate 24 and to mount the dispenser 10 on a stand, wall, or other support article. In the illustrated embodiment, the mounting assembly 26 includes a tubular stem 28 that is configured to be attached to a stand. In other embodiments, the tubular stem 28 could be replaced with a wall bracket, a floor stand, etc. Referring to FIG. 7, a support plate 30 is mounted on the stem 28. Suitably, the support plate 30 can include an arrangement or holes that corresponds with an arrangement of holes formed in the mounting plate 24 so that fasteners 32 (e.g., bolts, etc.) may secure the mounting plate to the support plate and thereby secure the dispenser 10 to the mounting assembly 26. The dispenser may also be attached to the mounting assembly in other ways without departing from the scope of the invention.

Figure 4:
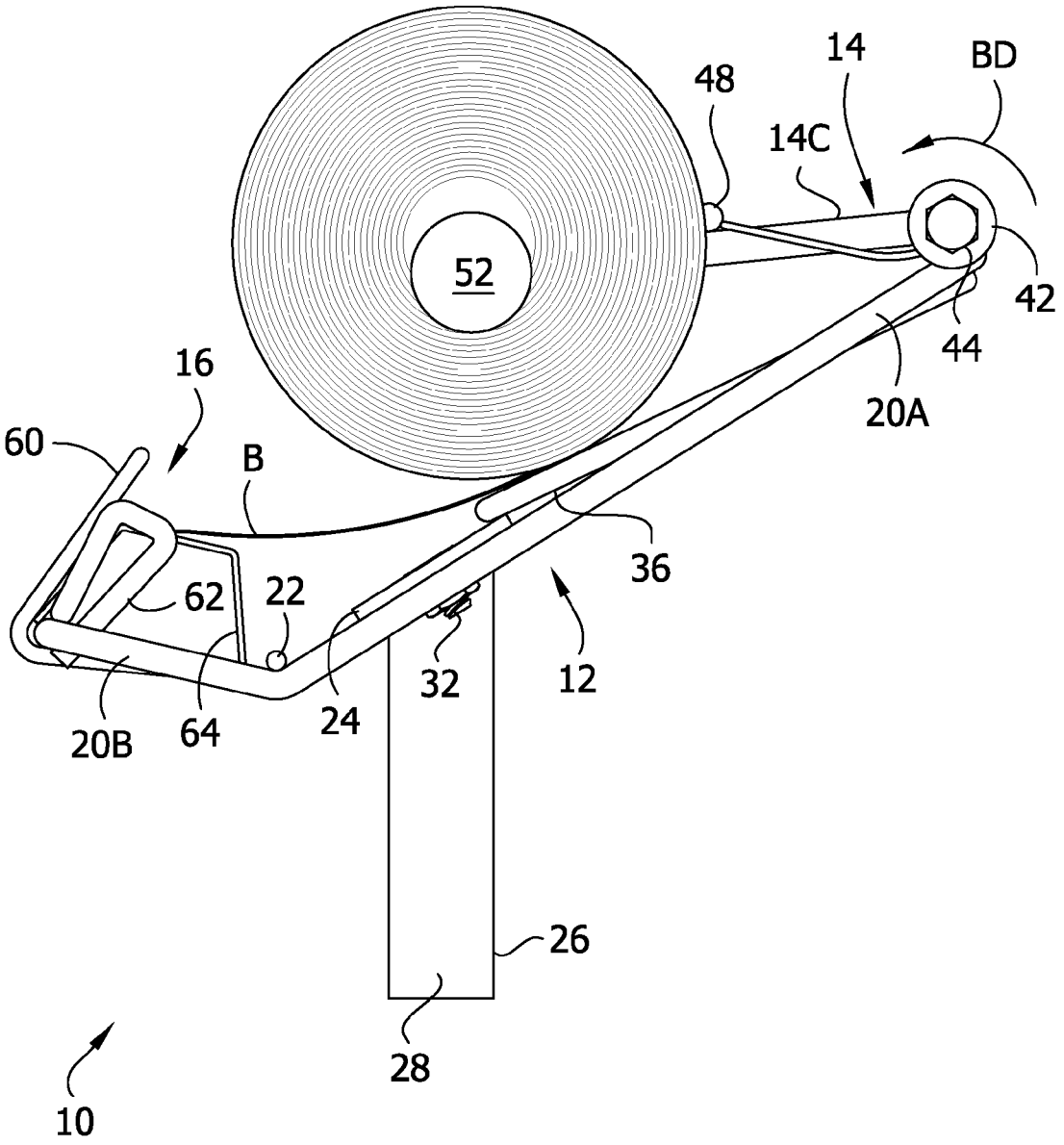
FIG. 4 is a side elevation of the bag dispenser and the roll of bags.

In the illustrated embodiment, the base 12 includes a roll stabilizer 36 that is separately attached to the support frame 20 and the mounting plate 24. As will be explained in further detail below, the roll stabilizer 36 is configured to engage the roll R and to maintain the roll R in the proper position in use. As explained below, the engagement between the roll R and the roll stabilizer 36 also provides a brake against freewheeling rotation of the roll. It will be understood that in other embodiments the roll stabilizer may be formed by a portion of the support frame or mounting plate, instead of being a separately attached component. In the illustrated embodiment, the roll stabilizer 36 has a rigid wire frame construction. The rigid wire that forms the roll stabilizer 36 is bent to have an elongate rectangular shape comprising a rear segment, a front segment, and opposite first and second side segments. The side segments of the roll stabilizer 36 are spaced apart inwardly from the side segments of the support frame 20. As shown in FIG. 4, the rear segment of the roll stabilizer 36 is attached (e.g., by welding) to the bottom side of the rear segment of the support frame 20. The front segment of the roll stabilizer 36 is attached (e.g., by welding) to the top edge margin of the mounting plate 24. Thus, the roll stabilizer 36 extends in a plane that is oriented at a skew angle with respect to the plane of the rear portion 20A of the support framed 20 in the illustrated embodiment.

Referring to FIG. 6, the base 12 includes a bearing collar 40 that, as explained in further detail below, is configured to rotatably receive a segment of the swing arm 14 therein. In the illustrated embodiment, the bearing collar 40 comprises a single elongate tube. The bearing collar could also have other constructions (e.g., the bearing collar could comprise a roller bearing, the bearing collar could comprise spaced apart collar members, etc.) without departing from the scope of the invention. The bearing collar is located adjacent the rear end portion of the base 12. And more specifically, the bearing collar is attached (e.g., welded) to the top side of the rear segment of the support frame 20.

Figure 3:
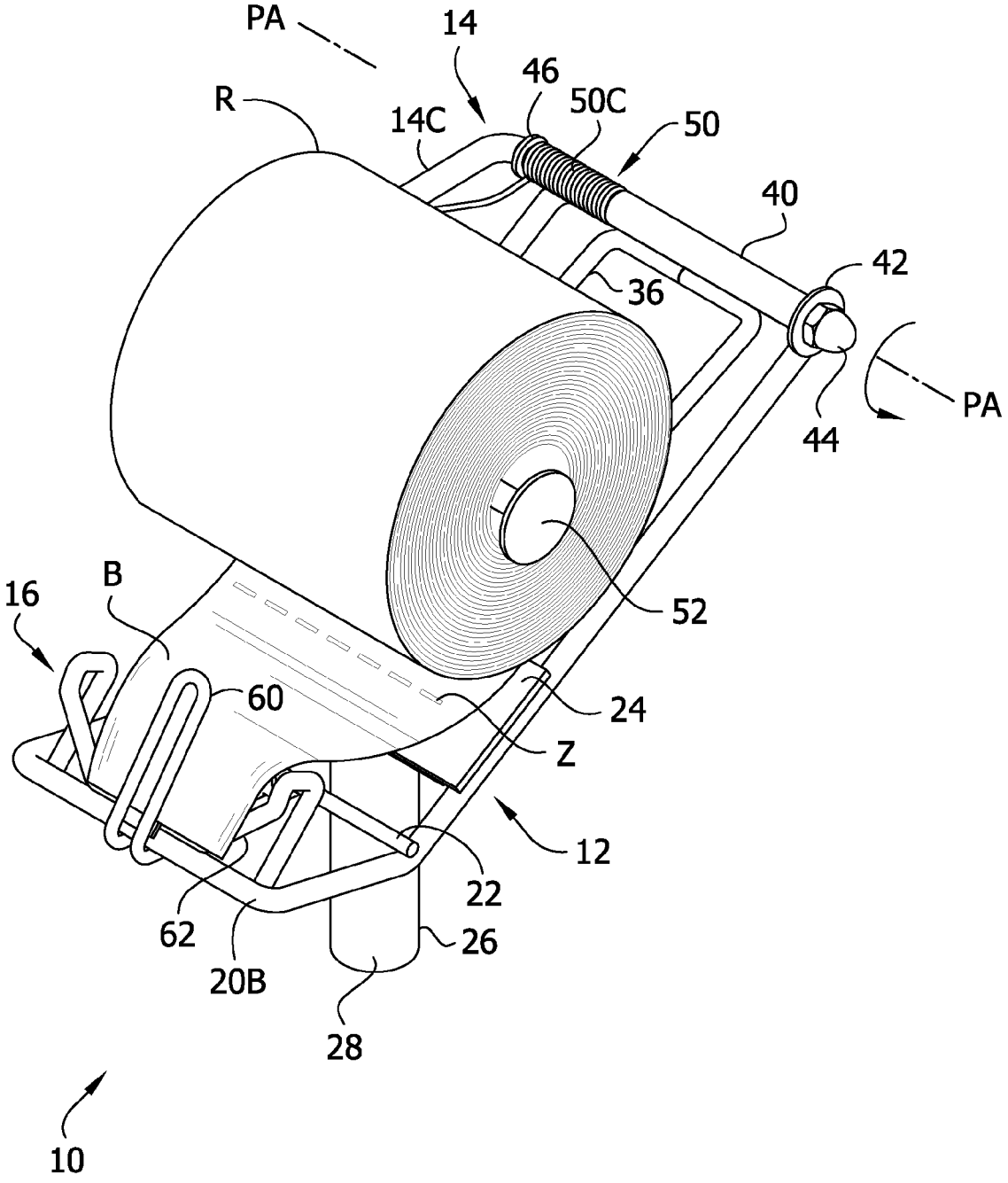
FIG. 3 is a perspective of the bag dispenser with a roll of bags installed in the dispenser.
Figure 5:
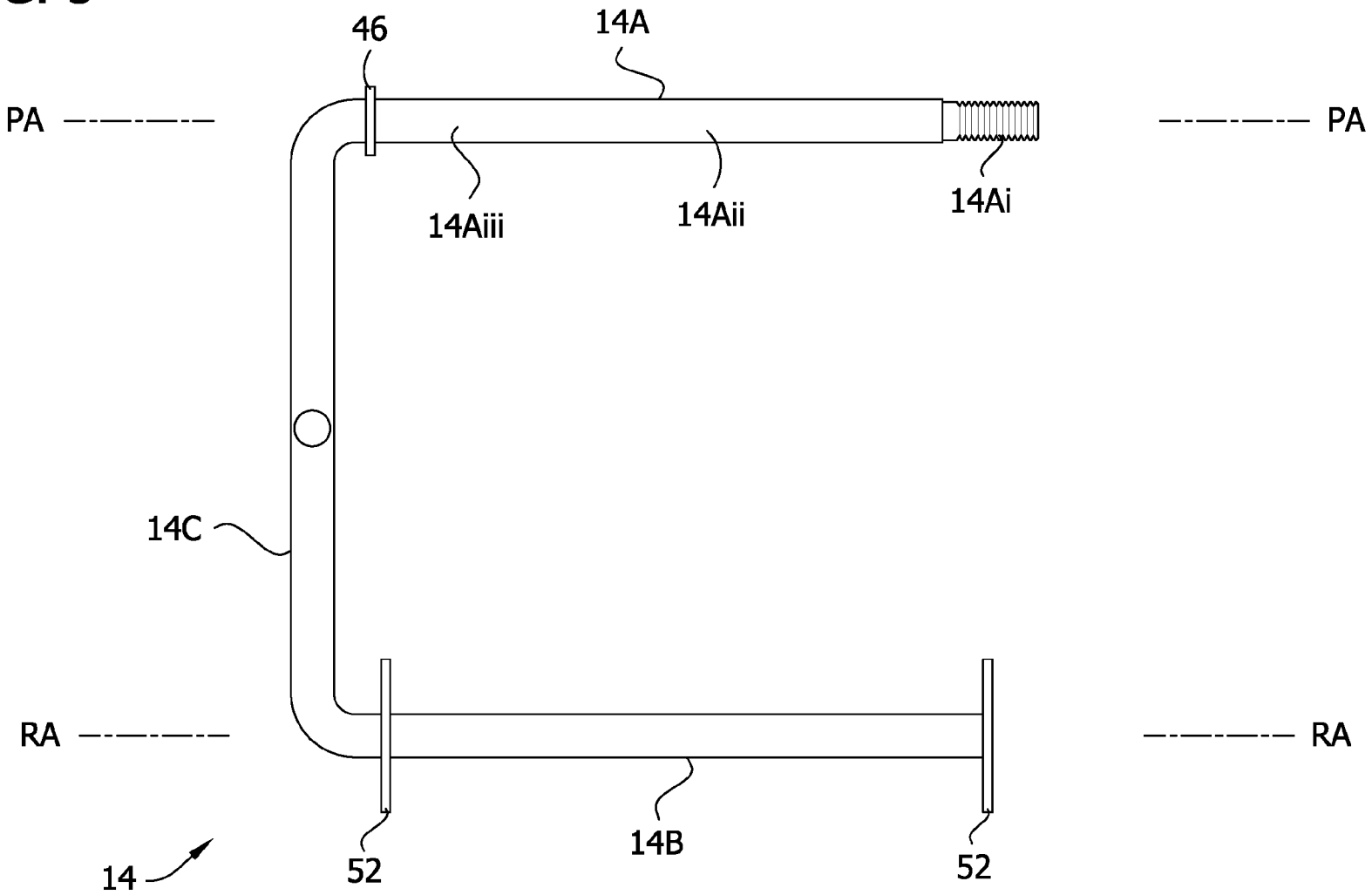
FIG. 5 is a top plan view of a swing arm of the bag dispenser.

Referring to FIG. 5, the swing arm 14 comprises an elongate arm member (e.g., a rod or dowel) that is formed into a U-shape. The swing arm 14 includes a pin portion 14A, a roll retaining portion 14B, and an intermediate portion 14C. The pin portion 14A of the swing arm 14 extends along a pivot axis PA from a first end of the intermediate portion 14C, and the roll retaining portion 14B extends along a roll retaining axis RA from a second end of the intermediate portion. As explained below, the swing arm 14 is configured to mount the roll R on the roll retaining portion 14B for rotation about an axis of the roll and, as shown in FIGS. 3 and 4, to pivot about the pivot axis PA with respect to the base 12 in a braking direction BD in which the roll retaining portion of the arm travels toward the base. In the illustrated embodiment, the roll retaining axis RA is spaced apart from and oriented parallel to the pivot axis PA. The intermediate portion 14C of the swing arm 14 extends radially of the pivot axis PA (and the roll retaining axis RA), interconnecting the pin portion 14A and the roll retaining portion 14B. The intermediate portion 14C could be generally straight, as shown in the illustrated embodiment, or be curved or otherwise nonlinear without departing from the scope of the invention.

Referring to FIGS. 5 and 6, the pin portion 14A is configured to mount the swing arm 14 on the base 12 for rotation about the pivot axis PA. In the illustrated embodiment, the pin portion 14A includes a threaded end segment 14Ai adjacent the first end of the swing arm 14, a bearing segment 14Aii adjacent the threaded end segment, and a spring receiving segment 14Aiii adjacent the bearing segment and forming the inner end segment of the pin portion. A spring retention flange 46 is mounted on the pin portion 14Aiii at the inner end of the spring receiving segment 14Aiii. A spring, generally indicated at 50, is received over the spring receiving segment 14Aiii and captured between the flange 46 and an axial end of the bearing collar 40. A spring retention knob 48 is mounted on the intermediate portion 14C of the swing arm 14 at a location spaced apart between the pin portion 14A and the roll retaining portion 14B for operatively capturing an end of the spring 50. When the swing arm 14 is connected to the base 12, the bearing segment 14Aii is rotatably received in the bearing collar 40. The threaded end segment 14Ai projects from the bearing collar 40 and receives a nut 44 securing the swing arm 14 to the base 12. A washer 42 is disposed between the nut 44 and end of the bearing collar 40. The bearing collar 40 engages the bearing segment 14Aii and the washer 42 engages the end of the bearing collar to constrain the swing arm 14 to move in rotation about the pivot axis PA. The nut 44 and washer 42 capture the spring 50 between the flange 46 and the bearing collar 40 and thereby secure the swing arm 14 to the base. The nut 44 and washer 42 allow the swing arm 14 to be easily removed to replace the spring 50 if required. It will be understood that a swing arm may be pivotably secured to a base in other ways in other embodiments.

The roll retaining portion 14B of the swing arm is configured to mount the roll R of bags B for rotation about the axis of the roll. In some embodiments (not shown), the roll retaining portion 14B of the swing arm 14 is extendable to accommodate roles of different widths. Suitably, the roll retaining portion 14B is configured to be received in an axial opening of the roll R. In one or more embodiments, the roll retaining portion 14B has a substantially smaller cross-sectional size than the axial opening of the roll R. First and second flanges 52 are mounted on the roll retaining portion 14B adjacent the opposite ends thereof. When the roll retaining portion 14B is received in the axial opening of the roll R as shown in FIGS. 3 and 4, the roll is positioned between the flanges 52, and the flanges prevent the roll from moving along the roll retaining axis RA out of alignment with the bag separator 16. In certain embodiments, the flange 52 mounted on the free end of the swing arm 14 is selectively removable to allow the roll to be installed on the roll engaging portion 14B before the flange 52 is reattached. The flange 52 could also be rounded or tapered to make it easier to slip the roll R over the flange. When the force of the spring 50 acts on the swing arm 14, the roll retaining portion 14B presses against the roll R and positions the flanges 52 to act as lateral stops that set and maintain the lateral positioning of the roll. The roll retaining portion 14B has a cylindrical exterior surface that engages the interior surface of the roll R (e.g., the interior surface of a roll core or the interior surface of the rolled bags in the case of a coreless roll) in use. In the illustrated embodiment, the cylindrical exterior surface of the roll retaining portion 14B is a stationary bearing surface that bears against the interior of surface of the roll R as the roll rotates about its axis. A roller (not shown) that rotates about the roll retaining axis RA could also be mounted on the roll retaining portion 14B for rolling engagement with the interior of the roll R as is known in the art.

Figure 8:
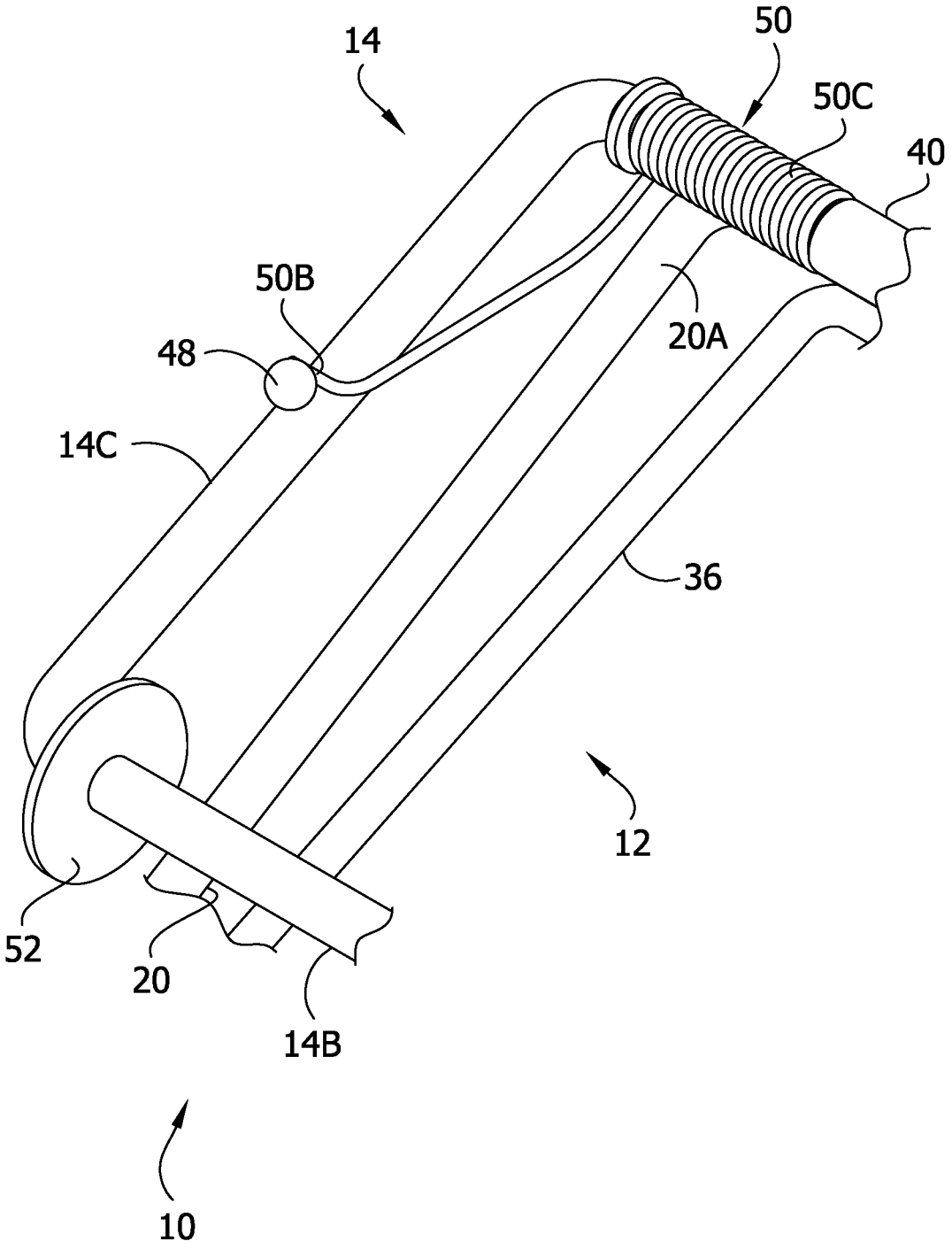
FIG. 8 is an enlarged, fragmentary perspective of the dispenser illustrating a connection between a spring and the swing arm.

Referring to FIGS. 6-8, the spring 50 suitably comprises a torsion spring having a base end portion 50A, an opposite swing arm end portion 50B, and a coiled portion 50C located therebetween. In one or more embodiments, the base end portion 50A extends radially with respect to the coils (i.e., the base end portion 50A is a radial spring end) and the swing arm end portion 50B extends tangentially with respect to the coils (i.e., the swing arm end portion 50B is a tangential spring end).

The spring 50 is operatively connected between the base 12 and the swing arm 14 to impart a biasing force therebetween. The coiled portion 50C of spring is located adjacent the bearing collar 40 and receives the spring receiving segment 14Aiii of the swing arm 14 therein. The pin portion 14A of the swing arm 14 is free of connection to the spring 50 and extends through the interior of the coiled portion 50C. Thus the pin portion 14A of the swing arm 14 can rotate about the pivot axis PA within the coiled portion 50C of the spring. As shown in FIG. 7, the base end portion 50A of the spring 50 is engaged with the base 12 to limit movement of the base end portion of the spring with respect to the base. More specifically, the base end portion 50A of the spring 50 conformingly engages the rear segment of the rear portion 20A of the support frame 20. The swing arm end portion 50B of the spring 50 is connected to the intermediate portion 14C of the swing arm 14 for conjoint movement therewith. More specifically, the swing arm end portion 50B is captured between the knob 48 and the intermediate portion 14C at a location spaced apart between the pin portion 14A and the roll engaging portion 14B of the swing arm 14. Pivoting movement of the swing arm 14 from an initial position in which the roll retaining portion 14B is located adjacent the base 12 (FIG. 1) in a direction opposite the braking direction BD causes the swing arm end portion 50B to travel with the intermediate portion 14C of the swing arm and to move relative to the base end portion 50A. As a result, the coiled portion 50C of the spring 50 deforms and the spring imparts a biasing force upon the swing arm 14 that urges the swing arm in the braking direction BD. The biasing force urges the roll R against the roll stabilizer 36 to ensure constant braking engagement between the roll and the stabilizer as bags B are unrolled and removed from the roll, thereby preventing freewheeling.

Figure 9:
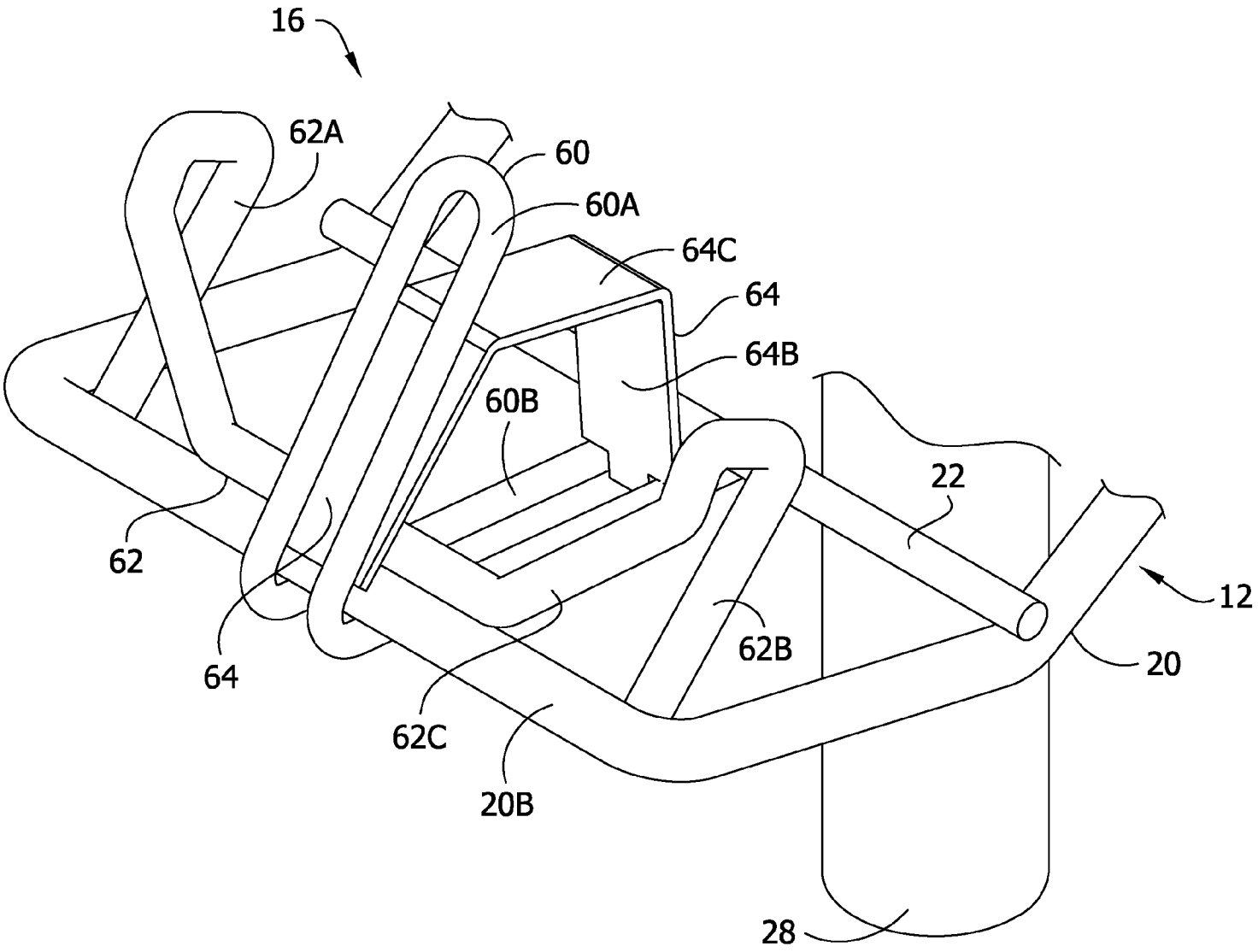
FIG. 9 is an enlarged, fragmentary perspective of the bag dispenser illustrating a bag separator thereof.

Referring to FIG. 9, the bag separator 16 includes a tongue 60 that projects from the base 12 adjacent the front end portion thereof. The tongue 60 is generally centered between the side segments of the support frame 20. The illustrated tongue 60 has a rigid wire frame construction. The tongue 60 is bent around and attached to the front segment of the front portion 20B of the support frame 20. An elongate top portion 60A of the tongue 60 projects upward and rearward toward the swing arm 14 from the front segment of the support frame 20. An elongate bottom portion 60B of the tongue 60 extends rearward from the front segment of the front portion 20B of the support frame 20 and is attached (e.g., by welding) to the cross wire 22. In the illustrated embodiment, the top portion 60A of the tongue 60 is about ½ inches wide. The included angle between the top portion 60A of the tongue 60 and the front segment 20B of the support frame 20 defines the attack angle of the tongue. In one or more embodiments, the attack angle of the tongue 60 is in an inclusive range of from about 50° to about 70°, such as about 60°.

As bags B are unrolled from the roll R, they are pulled across the top portion 60A of the tongue 60. Adjacent bags B on the roll R are delimited by a zone of weakness Z as shown in FIG. 3. In one embodiment, a slit is formed in a central region of the zone of weakness Z for cooperation with the bag separator 16. As a downstream bag B is unrolled from the roll R so that the zone of weakness Z travels across the top portion 60A of the tongue 60, the tongue passes through the central slit and catches the upstream bag. The tongue 60 thus restrains the upstream bag from further forward movement. Further pulling of the downstream bag B, tears the bag from the roll R along the zone of weakness Z, as the upstream bag remains caught against the tongue 60.

Referring again to FIG. 9, the bag separator 16 further comprises a guide scoop 62 at the front segment 20B of the support frame 20 that defines a concave guide surface that is generally aligned with the tongue. The illustrated guide scoop 62 comprises a bent rigid wire having a first end that is secured to the front segment of the front portion 20B of the support frame 20 adjacent the first side segment of the support frame and an opposite second end that is secured to the front segment of the support frame adjacent the second side segment of the support frame. The guide scoop 62 defines first and second side portions 62A, 62B that define vertically oriented sides of the concave guide surface. In the illustrated embodiment, the side portions 62A, 62B are generally hook-shaped. A front portion 62C of the guide scoop 62 extends between the first and second side portions 62A, 62B and defines an upwardly facing portion of the concave guide surface. In the illustrated embodiment, the front portion 62C of the guide scoop 62 has a truncated V-shape and includes a horizontal bottom segment that is supported on the front segment of the support frame 20. It will be understood that the guide scoop can have different configurations in other embodiments. In use, as the bags B are unwound from the roll R, the concave guide surface of the guide scoop 62 guides the bags toward the tongue 60 and ensures the bags stay aligned with the tongue 60 as they are removed from the roll.

The illustrated bag separator 16 further comprises a retainer 64 configured to retain the upstream bag B in position against the tongue 60 after the downstream bag has been removed. In the illustrated embodiment, the retainer 64 is formed from a rigid flat strip of material that comprises a front portion 64A, a rear portion 64B, and a top portion 64C extending between the front and rear portions. The front portion 64A extends generally parallel to the top portion 60A of the tongue 60 and is located between the tongue and the swing arm 40—and in the illustrated embodiment, between the tongue and the guide scoop 62—immediately adjacent to the tongue. The front portion 64A defines an end of the retainer member 64 that is attached (e.g., welded) to the front segment of the front portion 20B of the support frame 20. The top portion 64C extends rearward from the top of the front portion 64A, and the rear portion 64B extends downward and rearward from the rear end of the top portion. The bottom end of the rear portion 64B is attached (e.g., welded) to the bottom portion 60B of the tongue 60 adjacent the cross wire 22. In use, as a downstream bag B is pulled across the working end of the tongue 60, it is pulled downward or inward along the tongue. As the tongue 60 separates the downstream bag B from the adjacent upstream bag, the upstream bag is pulled downward into the region between the front portion 64A of the retainer member 64 and the top portion 60A of the tongue 60. The retainer member 64 and the tongue 60 together act as a clip that holds the bag B in place until it is intentionally removed.

In the illustrated embodiment, the top portion 64C of the retainer 64 is spaced apart from the top of the tongue 60 along an axis oriented perpendicular to the top portion by a distance of about ⅝ inches. Thus, the about ½-inch wide tongue 60 protrudes above the retainer by about ⅝ inches at an attack angle of from about 50° to about 70°. This configuration of the bag separator 16 has been found to perform consistently. That is, the tongue 60 consistently passes through the slit formed in the zone of weakness Z to catch the upstream bags B as the downstream bags are unrolled and separated from the roll R.

Referring again to FIGS. 3 and 4, to use the dispenser, a roll R of bags B is loaded onto the swing arm 14. Prior to receiving the roll R, the spring 50 maintains the swing arm 14 in an initial position in which the roll engaging portion 14B is positioned adjacent to (e.g., in engagement with) the base 12. The spring 50 may have a substantially non-deformed orientation in the initial position. To position the roll engaging portion 14B for receiving the roll R, the swing arm 14 is pivoted opposite the braking direction BD from the initial position until the roll engaging portion is spaced apart from the roll stabilizer 36 by a distance that is greater than the radius of the roll. The pin portion 14A rotates in the bearing collar 40 and within the coiled portion 50C of the spring 50 as the swing arm 40 pivots. In addition, the intermediate portion 14C of the swing arm rotates about the pivot axis PA, and the swing arm end portion 50B of the spring 50 travels with the knob 48 and intermediate portion to deform the spring. With the swing arm 14 in the proper position, the roll R is slipped onto the roll engaging portion 14B. After the roll is inserted, the swing arm 14 is released. The spring 50 resiliently returns toward a non-deformed orientation, which forces the swing arm end 50B of the spring in the braking direction BD. This imparts a biasing force on the swing arm 14 in the braking direction BD, which urges the roll engaging portion 14B into engagement with the roll R and urges the flanges 52 into positions overlying sides of the roll to restrain lateral movement of the roll. The biasing force acting on the swing arm 14 in the braking direction BD urges the roll into braking engagement with the roll stabilizer 36 of the base 12.

To remove a bag B from the roll R, the bag at the outer end of the roll is pulled forward, which causes the roll to rotate in the unwinding direction. The bag B must be pulled with sufficient force to overcome the braking force provided by the spring-biased engagement between the roll R and the stabilizer 36. And as soon as the pulling force imparted on the roll R is diminished, the braking engagement causes rotation of the roll to stop. Thus, the biased braking provided by the spring 50 prevents the roll R from freewheeling on the swing arm 14.

As a downstream bag B is pulled from the roll R, the concave guide surface of the guide scoop 62 maintains alignment between the bag and the tongue 60. The bag B is typically pulled downward or inward along the tongue as it is unwound. The tongue 60 catches the zone of weakness Z as it travels across the separator 16 and catches the upstream bag B. Further pulling of the downstream bag B, tears the bag from the roll R along the zone of weakness Z and pulls the upstream bag into the region between the front portion 64A of the retainer member 64 and the top portion 60A of the tongue 60. The retainer member 64 and the tongue 60 act as a clip that holds the remaining bag B in place until a user wishes to remove it.

As can be seen, the illustrated dispenser 10 ensures individual bags B are dispensed from the roll R in a controlled manner. The spring 50 maintains consistent braking engagement between the roll R and the roll stabilizer 36 to prevent freewheeling. In addition, the construction of the swing arm 14 and the separator 16 ensures that bags B remain laterally aligned with the tongue 60 as they are pulled from the roll R so that the bags are consistently separated from the roll as they are pulled past the separator.

When introducing elements of the present invention or the preferred embodiment(s) thereof, the articles "a", "an", "the" and "said" are intended to mean that there are one or more of the elements. The terms "comprising", "including" and "having" are intended to be inclusive and mean that there may be additional elements other than the listed elements.

As various changes could be made in the above apparatuses, systems, and methods without departing from the scope of the invention, it is intended that all matter contained in the above description and shown in the accompanying drawings shall be interpreted as illustrative and not in a limiting sense.

What is claimed is:

1. A dispenser for dispensing bags from a roll, the dispenser comprising:

a base having a first end portion and a second end portion;

a bag separator comprising tongue projecting from the base adjacent the first end portion thereof and configured to separate bags from the roll as the bags are pulled across the tongue;

a swing arm pivotably mounted on the base and including roll retaining portion shaped and arranged for being received in an axial opening of the roll and engaging the roll therein, the swing arm being pivotable with respect to the base about a pivot axis in a braking direction in which the roll retaining portion travels toward the base; and a spring operatively connected between the swing arm and the base to bias the swing arm in the braking direction whereby, when the roll retaining portion is received in the axial opening, the roll retaining portion engages the roll and urges the roll into braking engagement with the base.

2. A dispenser as set forth in claim 1 wherein the spring comprises a torsion spring having a tangential end portion and a radial end portion.

3. A dispenser as set forth in claim 2 wherein the tangential end portion of the spring is secured to the swing arm for movement therewith and the radial end portion of the spring is engaged with the base.

4. A dispenser as set forth in claim 3 wherein the swing arm includes a knob configured to capture the tangential end portion of the spring.

5. A dispenser as set forth in claim 1 wherein the spring comprises a coiled portion and a segment of the swing arm is received in the coiled portion.

6. A dispenser as set forth in claim 1 wherein the swing arm includes a pin portion that defines the pivot axis and an intermediate portion extending radially of the pivot axis between the pin portion and the roll retaining portion.

7. A dispenser as set forth in claim 6 wherein the base includes a bearing collar, the pin portion of the swing arm including a bearing segment received in the bearing collar for rotation about the pivot axis.

8. A dispenser as set forth in claim 7 wherein the spring comprises a coiled portion and the pin portion of the swing arm includes a segment that is rotatably received in the coiled portion.

9. A dispenser as set forth in claim 8 further comprising a flange mounted on the pin portion of the swing arm, the coiled portion of the spring being captured between the flange and the bearing collar.

10. A dispenser as set forth in claim 7 wherein the pin portion has a threaded end segment projecting out of the bearing collar.

11. A dispenser as set forth in claim 10 further comprising a nut threadably mated with the threaded end segment of the pin portion to secure the swing arm to the base.

12. A dispenser as set forth in claim 7 wherein the bearing collar comprises an elongate tube.

13. A dispenser as set forth in claim 7 wherein the bearing collar is located adjacent the second end portion of the base.

14. A dispenser as set forth in claim 6 further comprising a knob mounted on the intermediate portion of the swing arm between the pin portion and the roll retaining portion.

15. A dispenser as set forth in claim 14 wherein the spring comprises a swing arm end portion engaged with the knob.

16. A dispenser as set forth in claim 6 wherein the roll retaining portion of the swing arm extends generally along an axis that is parallel to and spaced apart from the pivot axis.

17. A dispenser as set forth in claim 1 wherein the bag separator further comprises a guide scoop located between the tongue and the swing arm and defining a concave guide surface that is generally aligned with the tongue.

18. A dispenser as set forth in claim 1 wherein the bag separator further comprises a retainer member extending generally parallel to the tongue and located between the tongue and the swing arm immediately adjacent to the tongue.

19. A dispenser for dispensing bags from a roll, the dispenser comprising:

a base having a first end portion and a second end portion;

a bag separator comprising tongue projecting from the base adjacent the first end portion thereof and configured to separate bags from the roll as the bags are pulled across the tongue;

a bearing collar mounted on the base adjacent the second end portion thereof;

a swing arm comprising a pin portion, an intermediate portion, and a roll retaining portion, the pin portion extending from the first end of the intermediate portion along a pivot axis, the roll retaining portion extending from the second end of the intermediate portion along an axis parallel to and spaced apart from the pivot axis, and the intermediate portion extending between and connecting the pin portion and the roll retaining portion, the pin portion including a bearing segment that is rotatably received in the bearing collar to constrain the swing arm for pivoting movement about the pivot axis with respect to the base, the swing arm being pivotable with respect to the base about the pivot axis in a braking direction in which the roll retaining portion travels toward the base; and a spring comprising a base end portion, an opposite swing arm end portion, and a coiled portion extending therebetween, the coiled portion of spring being located adjacent the bearing collar and receiving the pin portion of the swing arm therein, the base end portion of the spring being engaged with the base and the swing arm end portion of the spring being operatively connected to the intermediate portion of the swing arm for conjoint movement therewith, the spring being oriented with respect to the swing arm and the base such that pivoting movement of the swing arm from a position in which the roll retaining portion is located adjacent the base in a direction opposite the braking direction deforms the spring whereby the spring imparts a biasing force upon the swing arm that urges the swing arm in the braking direction.

* * * * *